US010801698B2

(12) United States Patent
Boonekamp

(10) Patent No.: US 10,801,698 B2
(45) Date of Patent: Oct. 13, 2020

(54) HIGH VISUAL COMFORT ROAD AND URBAN LED LIGHTING

(71) Applicant: SIGNIFY HOLDING B.V., Eindhoven (NL)

(72) Inventor: Erik Paul Boonekamp, Bunnik (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/493,640

(22) PCT Filed: Mar. 14, 2018

(86) PCT No.: PCT/EP2018/056325
§ 371 (c)(1),
(2) Date: Sep. 12, 2019

(87) PCT Pub. No.: WO2018/172149
PCT Pub. Date: Sep. 27, 2018

(65) Prior Publication Data

US 2020/0003395 A1 Jan. 2, 2020

(30) Foreign Application Priority Data

Mar. 20, 2017 (EP) ..... 17161843

(51) Int. Cl.
*F21V 13/04* (2006.01)
*F21V 7/00* (2006.01)
(Continued)

(52) U.S. Cl.
CPC ..... *F21V 13/04* (2013.01); *F21V 3/049* (2013.01); *F21V 5/045* (2013.01); *F21V 7/0025* (2013.01);
(Continued)

(58) Field of Classification Search
CPC ..... F21V 13/04; F21V 7/0025; F21V 7/04; F21V 5/045; F21V 7/041; F21V 7/046; F21V 3/049
See application file for complete search history.

(56) References Cited

U.S. PATENT DOCUMENTS 8,414,161 B2 * 4/2013 Holder ..... F21K 9/00 362/311.06
9,435,493 B2 9/2016 Pickard

FOREIGN PATENT DOCUMENTS

CN 102410496 A 4/2012
CN 203273700 U 11/2013
(Continued)

*Primary Examiner* — Joseph L Williams
(74) *Attorney, Agent, or Firm* — Daniel J. Piotrowski

(57) ABSTRACT

The invention provides a lighting system having a light source, a first reflective element, a second reflective element, and a lens, wherein the first reflective element tapers from a first end to a second end, the first reflective element includes a first reflective surface bridging the distance between the first end and the second end, wherein the first reflective surface is diffuse reflective, and wherein the light source is at least partially circumferentially surrounded by the first reflective surface, the light source is configured closer to the second end than to the first end to direct at least part of the light source light in the direction of the first end, the lens is configured to beam shape at least part of the light source light emanating from the reflective element and the light source, and the second reflective element is configured to redirect part of the light source light to the lens, wherein the second reflective element is configured to specularly reflect at least part of the light source light that reaches the second reflective element.

15 Claims, 9 Drawing Sheets

(51) Int. Cl.

| | |
|---|---|
| ***F21V 7/04*** | (2006.01) |
| ***F21V 3/04*** | (2018.01) |
| ***F21V 5/04*** | (2006.01) |
| *F21Y 115/10* | (2016.01) |
| *F21S 8/08* | (2006.01) |
| *F21W 111/02* | (2006.01) |

(52) U.S. Cl.

CPC ..... *F21V 7/04* (2013.01); *F21V 7/041* (2013.01); *F21V 7/046* (2013.01); *F21S 8/085* (2013.01); *F21W 2111/02* (2013.01); *F21Y 2115/10* (2016.08)

(56) References Cited

FOREIGN PATENT DOCUMENTS

| | | | |
|---|---|---|---|
| EP | 2888523 | B1 | 5/2016 |
| GB | 2464919 | A | 5/2010 |
| WO | 2005078338 | A1 | 8/2005 |
| WO | 2015038869 | A2 | 3/2012 |

* cited by examiner

HIGH VISUAL COMFORT ROAD AND URBAN LED LIGHTING

CROSS-REFERENCE TO PRIOR APPLICATIONS

This application is the U.S. National Phase application under 35 U.S.C. § 371 of International Application No. PCT/EP2018/056325, filed on Mar. 14, 2018, which claims the benefit of European Patent Application No. 17161843.2, filed on Mar. 20, 2017. These applications are hereby incorporated by reference herein.

FIELD OF THE INVENTION

The invention relates to a lighting system and to a lamp comprising such lighting system. Further, the invention relates to a kit of parts for creating or adapting such lighting system. Yet further, the invention relates to a method of lighting.

BACKGROUND OF THE INVENTION

Wide beam street lighting is known in the art. U.S. Pat. No. 8,414,161 B2, for instance, describes an apparatus and method characterized by providing an optical transfer function between a predetermined illuminated surface pattern, such as a street light pattern, and a predetermined energy distribution pattern of a light source, such as that from an LED. A lens is formed having a shape defined by the optical transfer function. The optical transfer function is derived by generating an energy distribution pattern using the predetermined energy distribution pattern of the light source. Then the projection of the energy distribution pattern onto the illuminated surface is generated. The projection is then compared to the predetermined illuminated surface pattern to determine if it acceptably matches. The process continues reiteratively until an acceptable match is achieved. Alternatively, the lens shape is numerically or analytically determined by a functional relationship between the shape and the predetermined illuminated surface pattern and predetermined energy distribution pattern of a light source as inputs.

SUMMARY OF THE INVENTION

Most of the current LED road lighting luminaires are based on a large array of medium power LEDs in which each LED is provided with a single lens. These lenses allow a precise illumination of the road surface. However, a drawback of these systems is the pixelated appearance of the luminaire and the high glare/brightness contrast (high brightness at the lens positions and almost dark in between the lenses).

Hence, it is an aspect of the invention to provide an alternative lighting system, which preferably further at least partly obviates one or more of above-described drawbacks. The present invention may have as object to overcome or ameliorate at least one of the disadvantages of the prior art, or to provide a useful alternative. Further, the invention also provides a method of producing such alternative lighting system as well as a method of providing light with such lighting system.

In a first aspect, the invention provides a lighting system comprising a light source, configured to provide light source light, a first reflective element, a lens, and also a second reflective element, wherein: (i) the first reflective element tapers from a first end to a second end; wherein the first reflective element comprises a first reflective surface bridging the distance between the first end and the second end, wherein the first reflective surface is diffuse reflective, and wherein the light source is at least partially circumferentially surrounded by the first reflective surface; (ii) the light source is configured closer to the second end than to the first end, and wherein the light source is configured to direct at least part of the light source light in the direction of the first end; and (iii) the lens is configured (especially at the first end) to beam shape at least part of the light source light emanating from the reflective element and the light source. The second reflective element is especially configured to redirect part of the light source light to the lens, wherein the second reflective element is configured to specularly reflect at least part of the light source light that reaches the second reflective element (to the lens). The second reflective element bridges the distance(s) between the first reflective element and the lens so that upstream of the lens light source light is essentially fully blocked to propagate from a location at a first side of the second reflective element facing towards the light source to a location at a second side of the second reflective element facing away from the light source. Hence, the second reflective element has different heights over its length so that over its full length at each location the second reflective element extends from the first reflective element onto the lens. Thus, more blocking of light in undesired directions and direct to other directions by the reflective elements is attained, resulting in better light distributions with less distorting light.

With such lighting system, it is possible to provide a wide beam with a relevant part of the light at high angles. This is especially useful for street lighting. Further, such lighting system is a relatively simple lighting system, which may also allow an easy further tuning of the beam shape with additional option components (such as the second reflective element). Further, with such lighting system a relative even distribution of the light over an exit window, e.g. the lens, may be obtained, instead of a plurality of distinguishable light sources.

As indicated above the lighting system comprises a light source, a first reflective element, and a lens (and optionally a second reflective element).

The term "light source" may refer to a semiconductor light-emitting device, such as a light emitting diode (LEDs), a resonant cavity light emitting diode (RCLED), a vertical cavity laser diode (VCSELs), an edge emitting laser, etc. The term "light source" may also refer to an organic light-emitting diode, such as a passive-matrix (PMOLED) or an active-matrix (AMOLED). In a specific embodiment, the light source comprises a solid-state light source (such as a LED or laser diode). In an embodiment, the light source comprises a LED (light emitting diode). The term LED may also refer to a plurality of LEDs.

Further, the term "light source" may in embodiments also refer to a so-called chips-on-board (COB) light source (sometimes also indicated as "chip-on-board"). The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module. Hence, in embodiments the light source comprises a chip-on-board light source. The term "light source" may (thus) also relate to a plurality of light sources, such as 2-2000 solid state light sources.

Especially, the light source comprises a LED or a plurality of LEDs, such as a COB. LEDs are essentially Lambertian emitters.

The light source is especially a (substantially) Lambertian emitter. The radiant intensity or luminous intensity observed from an ideal diffuse radiator or Lambertian emitter is substantially directly proportional to the cosine of the angle θ between the direction of the incident light and the surface normal. Hence, the light distribution of the light generated by the light source may essentially have a Lambertian emitter distribution (or cosine distribution).

The light source may especially be configured to provide white light, though optionally the light source may also be configured to provide colored light. As the term light source may also refer to a plurality of light sources (such as (in fact) a COB), in embodiments the light source may also be configured to provide light source light having a tunable spectral distribution. Hence, the lighting system may further comprise a control system, configured to control one or more of intensity and spectral distribution of the light source light, especially at least the intensity.

The term "controlling" and similar terms especially refer at least to determining the behavior or supervising the running of an element, such as the light source. Hence, herein "controlling" and similar terms may e.g. refer to imposing behavior to the element (determining the behavior or supervising the running of an element), etc., such as e.g. measuring, displaying, actuating, opening, shifting, changing temperature, etc. Beyond that, the term "controlling" and similar terms may additionally include monitoring. Hence, the term "controlling" and similar terms may include imposing behavior on an element and also imposing behavior on an element and monitoring the element.

As indicated above, in embodiments the light source may be configured to provide white light. The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

Further, the lighting system comprises a first reflective element. The first reflective element is especially configured to beam shape the light source light. Hence, in specific embodiments the first reflective element is configured around at least part of the light source. Especially, the first reflective element circumferentially surrounds the light source. Further, in embodiments the first reflective element, more precisely the first reflective surface, may have a conical shape. The side of the cone may have a curvature in one direction but may be flat in a perpendicular direction. However, the cone may also have two curvatures in perpendicular directions, like in the case of at least part of a parabolic reflector, which may have a kind of "bowl" shape. The opening angle may be relatively large. Hence, the reflector may have a relatively large width or diameter but may also be relatively thin (small height). Hence, in embodiments the first reflective element, more precisely the first reflective surface, has an opening angle (α), defined by the reflective surface, of at least 120° and of at maximum 170°.

In specific embodiments, the first reflective element is rotationally symmetric. Hence, the first reflective surface may especially be configured as (shallow) collector. Therefore, the first reflective may define a reflector cavity (which may be rotationally symmetric). The large opening angle (and thus small cut-off angle) allows providing a broad beam. In other embodiments, however, the first reflective element is not rotationally symmetric. For instance, the reflector may have the shape of a part of a "bowl". In embodiments, the first reflective element may comprise a plurality of faces. For instance, the first reflective element may comprise a multigonal pyramid, such as a hexagonal pyramid or a pyramid with even more faces, wherein the faces are curved in one or two directions.

Especially, the first reflective surface is a diffuse reflective surface. For instance, the first reflective element may comprise a coating of white particulate material. An example of a highly diffusively reflective material is Spectralon. The diffuse reflective surface is thus especially configured to scatter the light source light.

Therefore, in specific embodiments the first reflective element tapers from a first end to a second end; the first reflective element comprises a first reflective surface bridging the distance between the first end and the second end, the first reflective surface is diffuse reflective, and the light source is at least partially circumferentially surrounded by the first reflective surface.

Further, in specific embodiments the light source is thus configured closer to the second end than to the first end, and the light source is configured to direct at least part of the light source light in the direction of the first end. The reflective element may comprise a large opening at the first end and in embodiments a smaller opening at the second end. The light source may be configured in the opening at the second end. For instance, a light emitting surface of the light source, such as a LED die, may be configured at the opening at the second end. Hence, especially a light emitting surface of the light source may be configured closer to the second end than to the first end Further, the lighting system comprises a lens. With the lens, the beam may further be shaped. Especially a lens is selected which promotes that light at large angles (from an optical axis) (i.e. especially close to the reflective surface of the first reflective element) can still escape from. Hence, the lens may include prismatic structures, or other structures, that facilitate incoupling of light at large angles into the lens. The lens may be configured at the large opening at the first end. For instance, the lens may close the (large) opening at the first end.

In specific embodiments, the lens comprises a Fresnel lens. A Fresnel lens can capture more oblique light from a light source. Fresnel lenses are known in the art. A Fresnel lens may be a relatively thin optical lens comprising concentric rings of segmental lenses. A Fresnel lens can be seen as a modification of a conventional lens by dividing the lens into a set of concentric annular sections. An ideal Fresnel lens would have infinitely many such sections. In each section, the overall thickness may be decreased compared to an equivalent simple lens. This effectively divides the continuous surface of a standard lens into a set of surfaces of the same curvature, with stepwise discontinuities between them. In some lenses, the curved surfaces are replaced with flat surfaces, with a different angle in each section. Such a lens can be regarded as an array of prisms arranged in a circular fashion, with steeper prisms on the edges, and a flat or slightly convex center. In embodiments, the lens may comprise a plurality of refractive elements, especially configured to couple light at large angles relative to the optical axis into the lens, for outcoupling at the other side of the lens.

Hence, the (Fresnel) lens may have a relatively short focal length. Placing a light source at the focal point of the lens gives rise to a strong beam of nearly parallel rays. Hence, the light source may be configured at the focal point of the Fresnel lens.

The lens may be part of an exit window. In embodiments, the lens is an exit window. Essentially all light that escapes from the reflector cavity may escape only via the lens. Hence, the first reflective element may essentially be closed at the second end, and may include a window which comprises the lens (or which may be the lens) at the (opening at the) first end, with a hollow reflector cavity defined by the first reflective surface and the window, i.e. in specific embodiments the lens. At the second end, essentially (only) part of the light source may be available, and optionally a reflective support configured to support the light source. The hollow cavity is especially filled with air.

Therefore, the lens is especially configured to beam shape at least part of the light source light emanating from the reflective element and the light source. Light source light may thus escape from the system at the first end, essentially only via the lens (at the first end).

For further beam shaping, the reflector cavity may be adapted. For instance, for lighting of a road, a fully rotational symmetric beam may not be desired, but a more elongated beam is in general desired. Therefore, in yet further embodiments the lighting system further comprises reflective elements that block light in undesired directions and direct to other directions. In this way, at least part of the light that would otherwise be lost can be reused. Especially, such reflective elements are specular reflective, or semi-specular reflective. Hence, in embodiments at least 50% of the light that reaches such reflector is specularly reflected. For instance, for further reducing color-over-angle dependencies, a semi-specular second reflective element may be applied.

Therefore, in yet further embodiments the lighting system further comprises a second reflective element configured to redirect part of the light source light to the lens, wherein the second reflective element is especially configured to specularly reflect especially at least 50% of the light source light that reaches the second reflective element. Hence, the second reflective element may be configured to specularly reflect at least part of the light source light that reaches the second reflective element. Part of the light source light may directly irradiate the second reflective element, without intermediate reflections, and part of the light source light may only reach the second reflective element after (multiple) reflection(s). Further, as indicated elsewhere, part of the light source light will not reach the first reflective element neither the second reflective element, but leaves (the reflector cavity) via the lens.

The first reflective element may include a recess or other features that can be used to plug the second reflective element into. Or, the first reflective element may include a plurality of such recesses or other features which may allow to a certain extend a free arrangement of such second reflectors. Hereby, the user may tune the beam to the specific (local) desired beam properties.

Therefore, in yet further embodiments the first reflective element comprises a reflector wall comprising the first reflective surface, wherein the reflector wall comprises a slot for hosting a second reflective element. As indicated above, the term "slot" may also refer to a plurality of slots. The slot may e.g. a (narrow) recess wherein the second reflective element can be plugged. In specific embodiments, the second reflective element may be flexible. This further facilitates creating the desired beam shape and/or adapting the second reflective element to the slot(s) that are provided.

In specific embodiments, the first reflective element is rotationally symmetric, and the slot defines part of a circle segment, wherein the circle segment has a secant, which may optionally be curved, and wherein the slot defines at least part of the secant. As indicated above, a plurality of such secants may be available. The secant may optionally be curved, but which may also be straight, or which may have a curved part and a straight part, or two or more of such parts. Hence, the second reflective element may be configured in substantially any desired shape. When the second reflective element is provided in a first and a second (separate) part, then, when viewed in a projection along the optical axis, preferably at least a first part is, but more preferably both the first and the second part are, convexly shaped towards the second part, enabling a simpler beam shaping control of the desired light beam pattern. The second reflective element may have the feature that essentially not any tangent to a reflective surface (which faces towards the light source) of the second reflective element extends through the optical axis, which typically results in a desired batwing light distribution.

The second reflective element (including optionally a plurality of such elements, i.e. in separate first, second, third, . . . parts), may essentially be a free-form reflector, i.e. free in the XY-plane perpendicular to the optical axis of the device. Further, preferably each separate part of the second reflective element with its end portions divides a perimeter of the first reflective element, usually a circle (or virtual circle), of the first reflective surface in two (or more) segments. The second reflective element especially connects one point on the perimeter with another point on the same perimeter, said one point and said another point are lying apart at an angle $\beta$ on the perimeter, with $\beta$ in an angle range $60° <= \beta <= 170°$ between lines from the optical axis respectively to said one point and to said another point.

Especially, the presence of the second reflective element imposes a substantially non-rotationally symmetric beam shape of the lighting system light of the lighting system (which light is herein also indicated as beam).

The lighting d system may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, (outdoor) road lighting systems, urban lighting systems, green house lighting systems, horticulture lighting, etc. etc. In specific embodiments, the lighting system may be used or is configured for outdoor lighting such as lighting of a road or other open place, like a way, a drive, a lane, an avenue, a place, a track, rails, etc. etc.

In a further aspect, the invention provides a lamp comprising the lighting system as defined herein. Especially, the lamp is configured to provide a beam of lamp light with a non-rotationally symmetric shape. For instance, the lamp may be a street lamp, like a pole, etc.

As indicated above, the lighting system may be provided with one or more slots, which may be used to arrange one or more second reflective items in, to tune the beam shape to the desired beam for a specific solution, such as a specific road (part).

Hence, in yet a further aspect the invention also provides a kit of parts comprising (i) the lighting system as defined herein, wherein the first reflective element comprises a reflector wall comprising the first reflective surface, wherein the reflector wall comprises a slot for hosting a second reflective element, and wherein the kit of parts further comprises (ii) the second reflective element, wherein especially the second reflective element when configured in the slot is configured to specularly reflect at least part of the light source light, such as at least 50% of the light source light, that reaches the second reflective element during operation of the lighting system. As indicated above, especially the second reflective element may be configured to specularly reflect at least part of the light source light that reaches the second reflective element (in the direction of the lens).

Hence, the reflector wall may also comprise a plurality of slots. This may, as indicated above, allow the user to shape the beam as desired. This may even be an iterative process at the location where the lighting system is applied. This greatly enhances a broad application of the lighting system on all kind of (outdoor or indoor) locations. Therefore, in specific embodiments the reflector wall comprises a plurality of slots, and the kit of parts comprises a plurality of different second reflective elements. In specific embodiments, the second reflective elements are flexible. This may facilitate arranging the second reflective elements in the slot(s).

In embodiments, the configuration of the second reflective element and the slot is configured to provide an interference fit, also known as a press fit or friction fit. This allows a stable fixation of the second reflective element.

In yet a further aspect, the invention also provides a method of producing the lighting system from the elements as indicated—amongst others—above. Amongst others, the invention provides a method of providing the lighting system as described herein, wherein the method comprises (i) providing the light source, the first reflective element and the lens (and optionally the second light reflective element), and (ii) assembling these into the lighting system.

In embodiments, assembly may be done with techniques known in the art. One or more elements may also be produced by 3D printing. For instance, the first reflective element, or the second reflective element, or the lens, or parts of one or more of these, may be obtained by 3D printing. When the first reflective element, or at least part thereof, is 3D printed this allows creating of a dedicated lighting system. It may also allow a further reduction of material as e.g. the first reflector does not need to be e.g. fully conical when a second reflective element is applied. Hence, in embodiments the method may further comprise 3D printing at least part of the lighting system. Therefore, in embodiments the first reflective element may e.g. be non-rotationally symmetric, and at least part of the first reflective element is a 3D printed part. Also, the first reflective element may e.g. be rotationally symmetric, and at least part of the first reflective element is a 3D printed part. For instance, the reflector wall may be 3D printed, and may be reflective per se and/or may be provided with a reflective coating.

The use of 3D printing may (thus) not exclude the use of other techniques to produce other parts of the lighting system. For instance, coating technologies may be used to provide e.g. a specular reflective surface of the second reflective element or the diffuse reflective surface for the first reflective element.

As indicated above, one or more second reflective elements may be applied. Hence, in yet a further embodiment of the method, the method comprises providing a reflector wall comprising the first reflective surface, wherein the reflector wall comprises a slot, wherein the method further comprises (providing a second reflective element and) configuring the second reflective element in the slot. As indicated above, the second reflective element when configured in the slot is especially configured to specularly reflect at least 50% of the light source light that reaches the second reflective element during operation of the lighting system.

The lighting system can be used for indoor lighting or outdoor lighting. As indicated above, especially with the use of the second reflective elements the beam shape can be tuned, such as to a relative elongated beam with relative high intensities at large angles (from the optical axis).

Therefore, the invention provides in a further aspect a method of providing light, the method comprising providing lighting system light with the lighting system as defined herein or the lamp as defined herein, wherein relative to an optical axis of the lighting system at least 60% of the lighting system light, such as at least 70% of the lighting system light, is provided within an angular range of 40-90° relative to the optical axis.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1A:
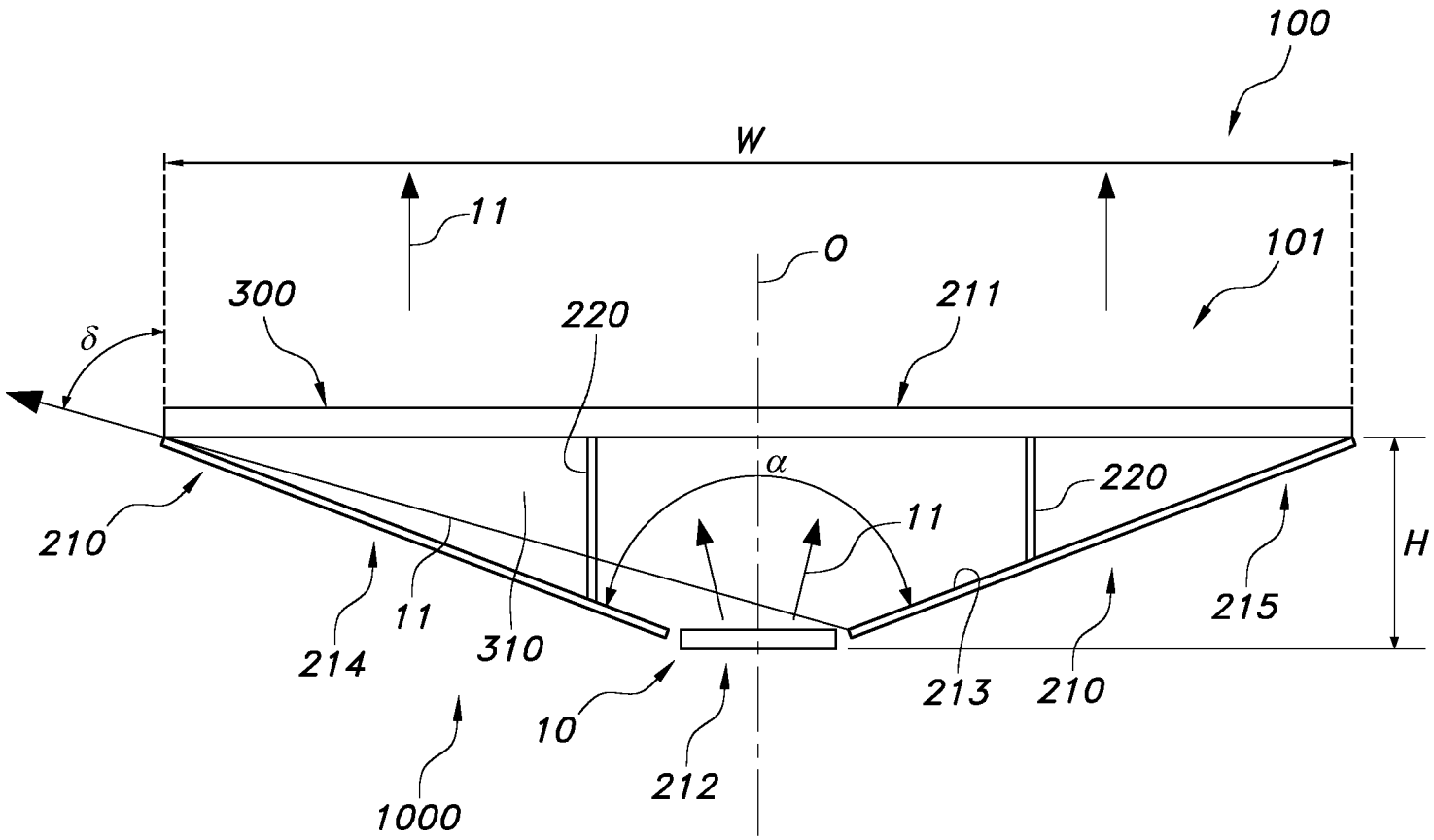
FIGS. 1*a*-1*e* schematically depict some aspects of the lighting system and lamp, as well as the kit of parts.

FIG. 1*a* schematically depicts an embodiment of the lighting system 1000 comprising a light source 10, configured to provide light source light 11, a first reflective element 210, and a lens 240, The first reflective element 210 tapers from a first end 211 to a second end 212. Here, the firs reflective element has a conical shape. The first reflective element 210 comprises a first reflective surface 213 bridging the distance between the first end 211 and the second end 212, wherein the first reflective surface 213 is diffuse reflective, such as a diffuse white reflector. The light source 10 is at least partially circumferentially surrounded by the first reflective surface 213. Here, the light emitting surface of the light source essentially closes the second end 212 of the first reflective element.

The light source 10 is configured closer to the second end 212 than to the first end 211. As can be seen, the light source 10 is configured to direct at least part of the light source light 11 in the direction of the first end 211. Hence, some light of the light source may escape from via the first end 201 without any reflection.

The lens 240 is configured to beam shape at least part of the light source light 11 emanating from the reflective element 210 and the light source 10. Especially, the lens may comprise a plurality of refractive elements, especially configured to couple light at large angles relative to the optical axis into the lens, for outcoupling at the other side (downstream side) of the lens. The lens may be a Fresnel lens, as very schematically depicted in FIG. 1*b*.

The opening at the first end may comprise a window 300, which is here the lens 240. The window has a light source side 302 and an opposite side, facing the external, indicated with reference 301. Likewise, the lens has a light source side 242 and an opposite side, facing the external, indicated with reference 241. Note that the Fresnel elements may especially be (only) configured at the upstream side or the light source side.

The terms "upstream" and "downstream" relate to an arrangement of items or features relative to the propagation of the light from a light generating means (here especially the light source), wherein relative to a first position within a beam of light from the light generating means, a second position in the beam of light closer to the light generating means is "upstream", and a third position within the beam of light further away from the light generating means is "downstream".

The first reflective element 210 has an opening angle α, defined by the reflective surface 213, of at least 120° and of at maximum 170°.

Reference 310 indicates the cavity that is essentially formed by the lens 240, the first reflective surface 213, the optional second reflective element 220 (see below) and the light source 210 (and optionally a support comprising the light source 210; not depicted here).

Further, as can be seen the first reflective element 210 is rotationally symmetric.

FIG. 1*a* also schematically depicts a lamp 100.

Optionally, the lighting system 1000 may further comprise a second reflective element 220 configured to redirect part of the light source light 11 to the lens 240. The second reflective element 220 may especially be configured to specularly reflect at least 50% of the light source light 11 that reaches the second reflective element 220.

Figure 1B:
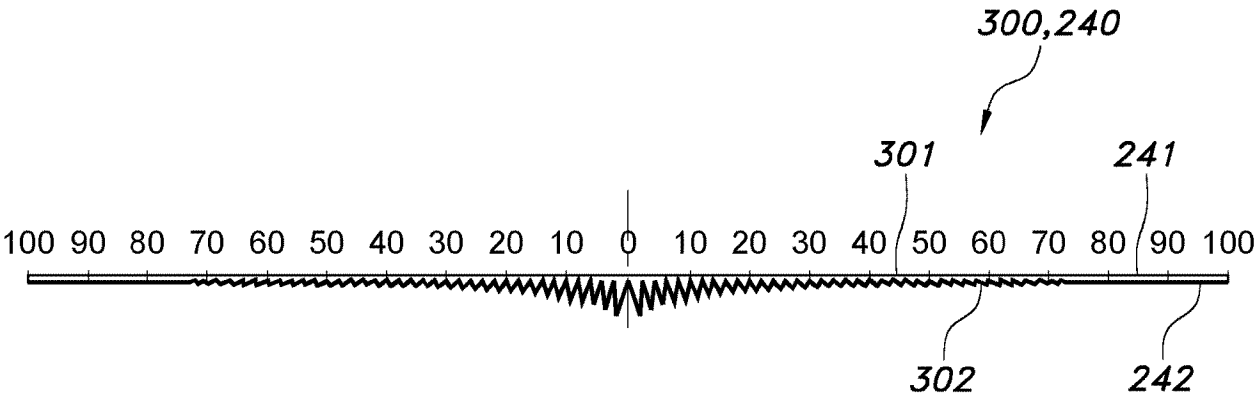

Hence, in embodiments, some basic features of the invention are an optical cavity in which a single Chips on Board (CoB) type LED is placed. The optical cavity in embodiments consists of a conical reflector part (white, diffuse) and a Fresnel lens. The modules can be characterized by the cut-off (δ (see FIG. 1*a*)), height (h) and diameter (w). The Fresnel lens has features only on the side directed to the light source. At least one free-form specular or semi-specular reflector can be placed in the cavity ("insert"). An example of a Fresnel lens is schematically indicated in FIG. 1*b*. Especially, the upstream side includes the Fresnel lens (elements), and the downstream side may essentially be flat. The upstream side is especially directed to the light source 10.

Figure 1C:
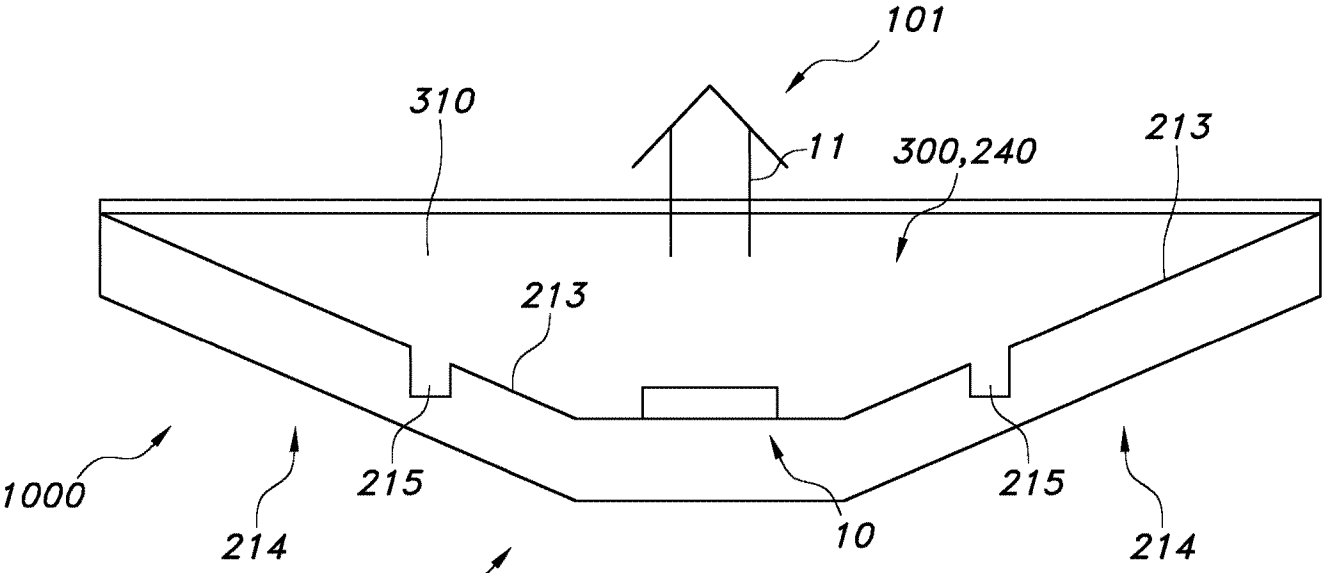

As shown in FIG. 1*c*, the lighting system 1000 the first reflective element 210 may comprise a reflector wall 214 comprising the first reflective surface 213. This reflector wall 214 may comprises a slot 215 for hosting a second reflective element 220.

As indicated above, the first reflective element 210 may be rotationally symmetric. However, the slot 215 may define part of a circle segment 216, wherein the circle segment 216 has a secant 216*a*, which may optionally be curved, but which may also be straight, or which may have a curved part and a straight part, or two or more of such parts, and wherein the slot 215 defines at least part of the secant 216*a*. Hence, the second reflective element 220 may be configured in substantially any desired shape.

Figure 1D:
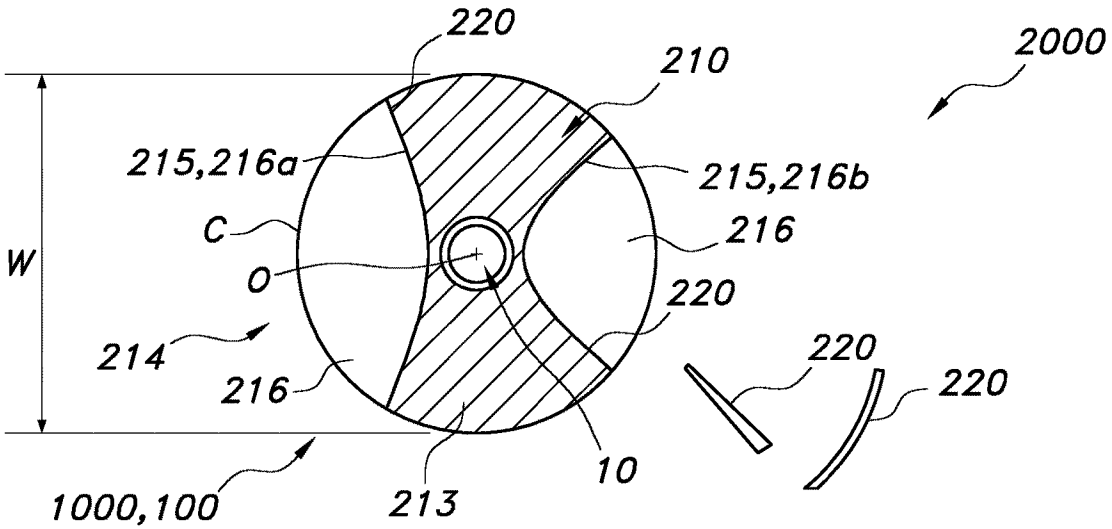

This is also schematically depicted in FIG. 1*d*.

FIG. 1*d* also schematically shows a kit of parts 2000 comprising the lighting system 1000. Here, the first reflective element 210 comprises a reflector wall 214 comprising the first reflective surface 213, wherein the reflector wall 214 comprises a slot 215 for hosting a second reflective element 220. The kit of parts 2000 further comprises the second reflective element 220, wherein the second reflective element 220 when configured in the slot 215 would configured to specularly reflect, e.g. at least 50% of the, light source light 11 that reaches the second reflective element 220 during operation of the lighting system 1000 (see FIGS. 1*a* and 1*c*). The reflector wall may also comprise a plurality of such slots, optionally having different shapes. Further, the kit of parts may comprise a plurality of (different) second reflective elements 220 (see by way of example the further second reflective elements 220 at the right). The differences may be in length, height, and optionally reflectivity.

The second reflective element (including optionally a plurality of such elements) may essentially be a free-form reflector (i.e. free in the XY-plane (perpendicular to the optical axis of the device)). Further, especially it divides the circle (or virtual circle) of the first reflective surface in two (or more) parts. The second reflective element 220 especially connects one point on the (virtual) circle with another point on the same (virtual) circle.

Here, the term "virtual circle" may also be used. For instance, when referring to FIG. 1*d* it may not be necessary to provide the entire circle of the first reflective element 210, or more precisely the first reflective surface 213. For instance, with 3D printing or other techniques, only the necessary elements may be provided, such as only the hatched area in FIG. 1*d*. The (virtual) circle is indicated with reference C.

Figure 1E:
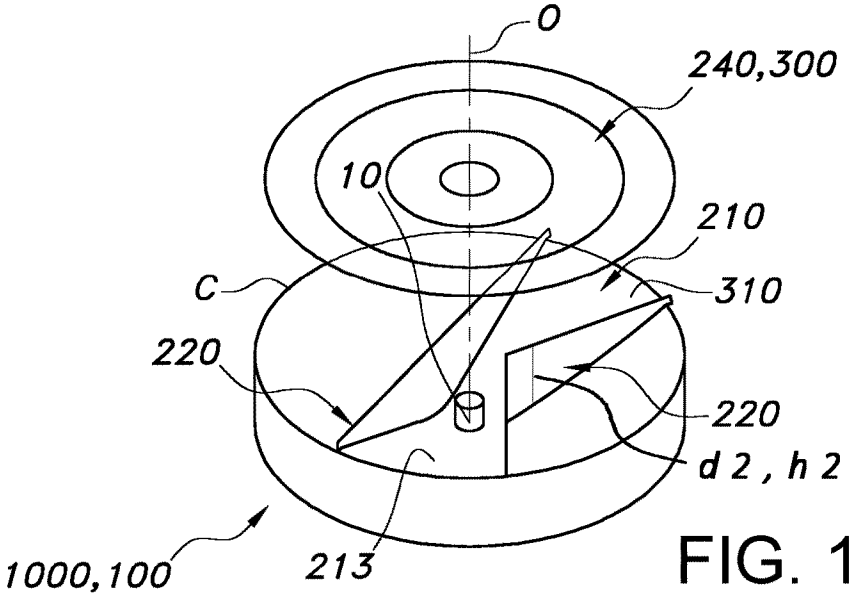

FIG. 1*e* schematically depicts an embodiment of the lighting system in perspective. The concentric rings indicate schematically the Fresnel lens embodiment. Here, a module is shown comprising the first reflective element and the second reflective element, the light source and the lens. The variable distance d2 between the first reflective element 210 and the lens 240 is indicated as well as the second reflective element 220 having a variable height h2 to bridge said variable distance d2 so that over its full length at each location the second reflective element 220 extends from the first reflective element 210 onto the lens 240. Thus, more blocking of light in undesired directions and direct to other directions by the reflective elements 210, 220 is attained.

Figure 2A:
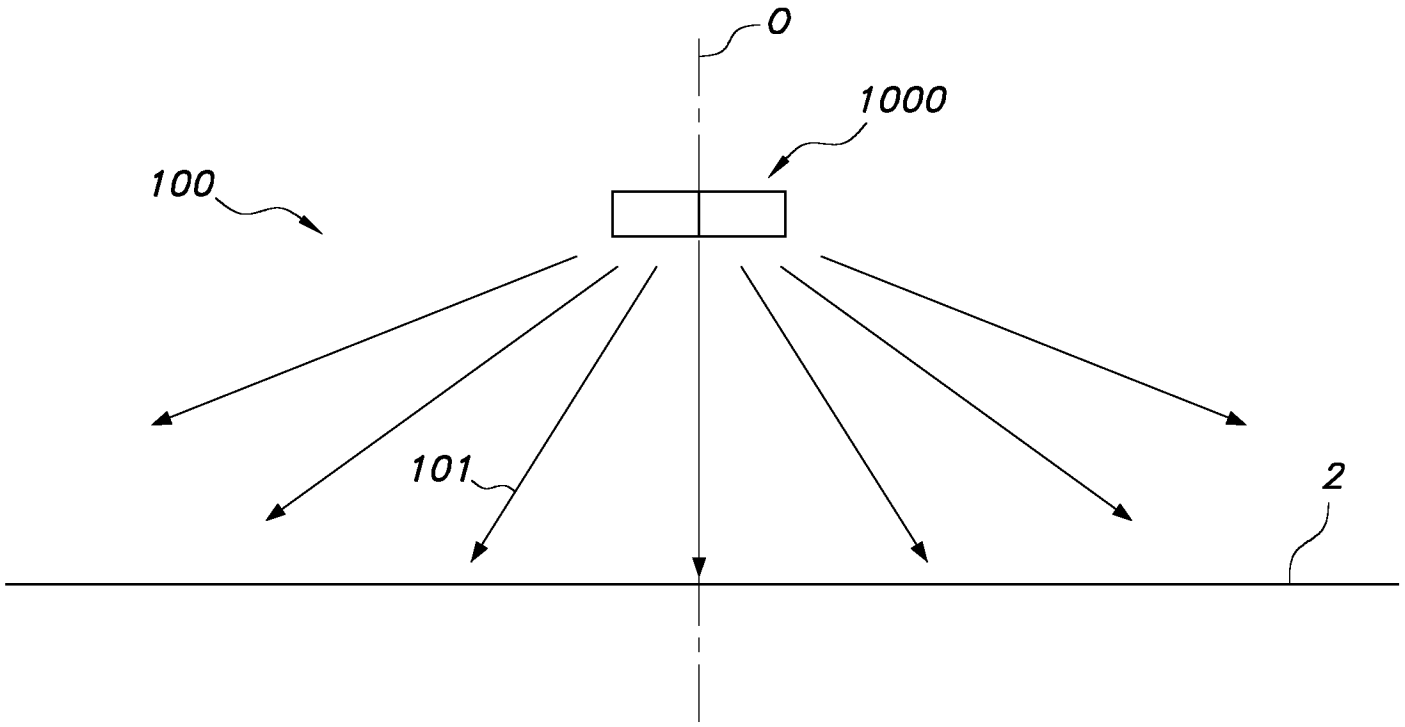
FIGS. 2*a*-2*c* (schematically) depict yet some further aspects of the lighting system and lamp.
Figure 2B:
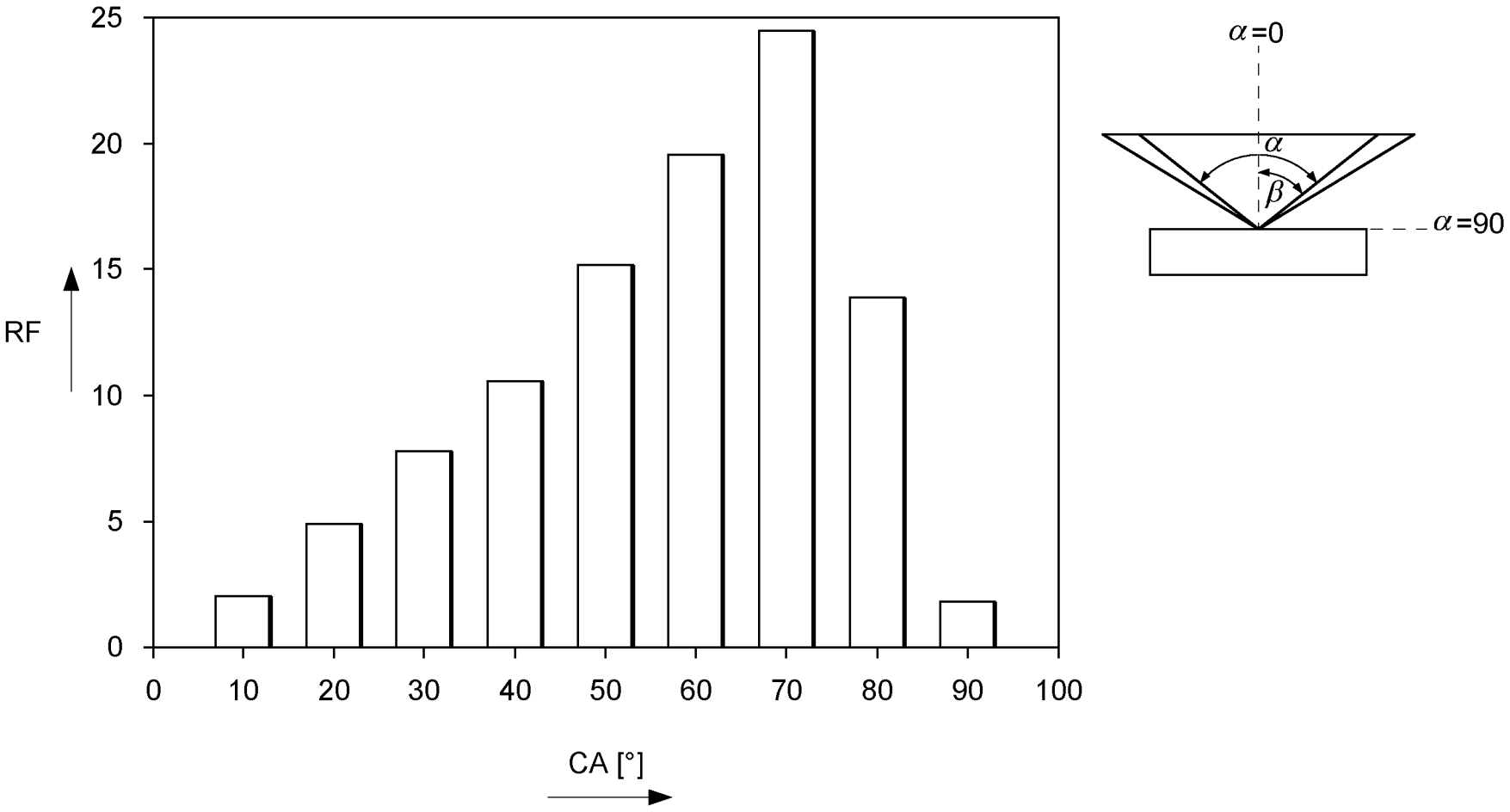
Figure 2C:
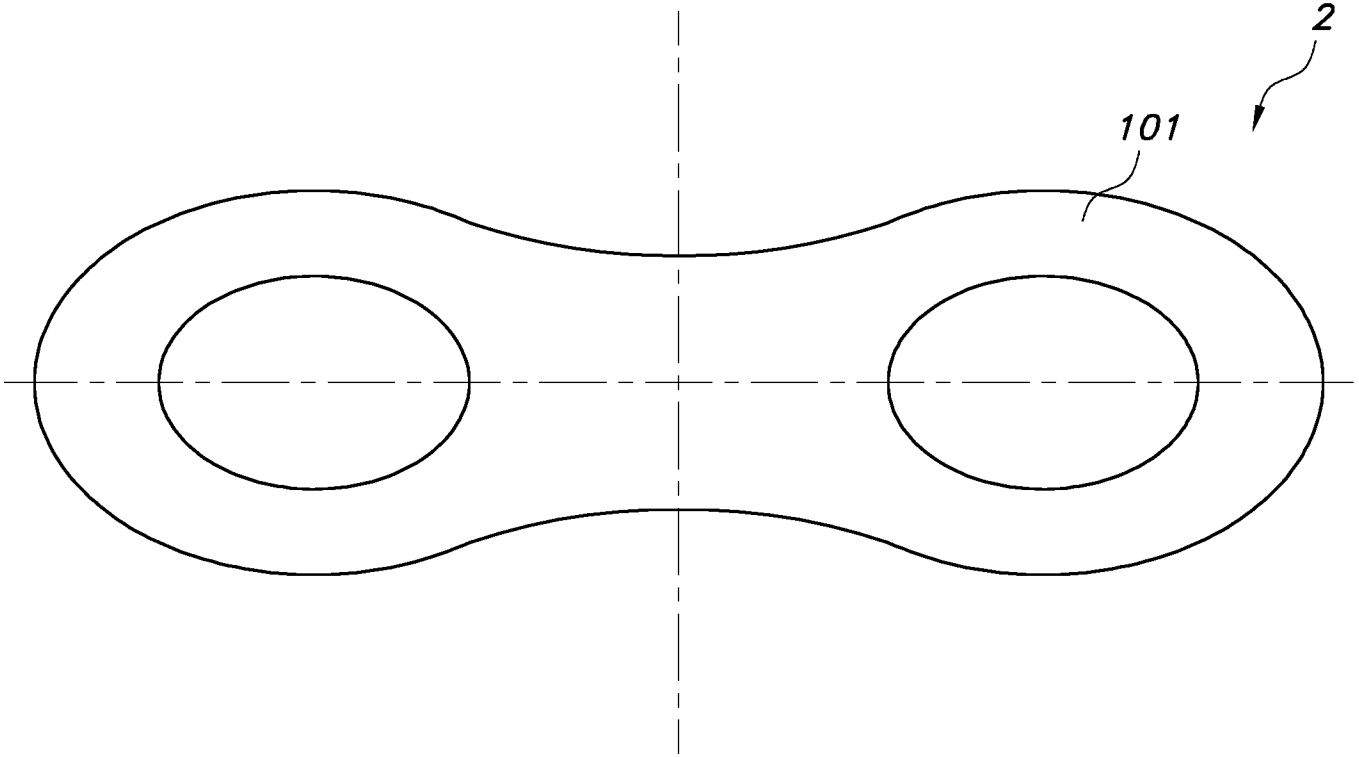

FIG. 2*a* schematically depicts a lamp 100 comprising the lighting system 1000, wherein the lamp 100 is configured to provide a beam 101 of lamp light. Reference 2 indicates a plane, such as a road. The beam 101 may have a non-rotationally symmetric shape, as very schematically depicted in FIG. 2*c*, with on the y-axis the relative flux (RF) and on the x-axis the cone angle (CA) β in ° (2*β is the opening angle). For instance, the bar at 10° indicates the intensity between 0-10°. Likewise, the bar at 90° indicates the intensity between 80-90°. The intensity distribution over the window of the lighting system, however, appeared to be relatively uniform. FIG. 2*c* schematically depicts thus a possible light pattern on the road and shows the illuminance (lm/m2).

Road lighting requires an intensity profile which ensures a uniform illumination of the road at the highest possible pole-pole distance and a limited glare. The white conical reflector creates a cut-off δ (typically 70-80° w.r.t. to the optical axis (z-direction)). The Fresnel lens directs the light from the CoB source to the high angles (w.r.t. the optical axis). The inserted (semi-)specular reflector(s) direct and collimate the light from the source to the required off-axis angles in the x-y plane. A significant amount of light (typically 30-40%) of the flux is scattered at the conical shaped, white reflector surface. The background of the CoB source is illuminated (although much less bright than the CoB itself). The fact that the whole optical surface emits light improves the visual comfort of the lighting system dramatically (compared to a lens array).

The Fresnel lens can be injection molded using a transparent polymer (PMMA, PC). The semi-specular or specular (mirror) sheets can be MIRO or MIRO-SILVER® from Alanod corporation (thickness 0.2-0.8 mm). The thin sheets can easily be curved and inserted in the white reflector. The white reflector can have a matte or high-gloss surface finish. The white reflector can be 3D printed (e.g. from white polycarbonate) or injection molded. Additive manufacturing or 3D printing techniques (e.g. Fused Deposition Modelling; FDM) allows the fabrication of a white reflector with multiple customized slots in which flexible reflectors can be inserted. The inserted specular reflector can also be a 3D printed part which is coated with a thin aluminum layer (evaporation, sputter deposition). Having a single type of Fresnel lens, a variety of beams can be created by printing the white reflector with the appropriate slots, followed by insertion of a mirror sheet. The mirrors can be laser cut from a sheet of MIRO-SILVER® and placed into these slots.

A prototype was built, with a matte, white conical reflector, two curved mirrors and a Fresnel lens. A CoB capable to generate 12.2 klm from a circular surface with a diameter of 22 mm (CRI 80, 4000 K) was used. The white reflector has the following parameters: h=40 mm, w=200 mm and δ=70 deg. (see FIG. 1*a*). The Fresnel lens is designed in such a way that all light directly from the source is directed to an angle of 70 deg. w.r.t. the optical axis.

The facet structure of the Fresnel lens may also change depending on the position on the circumference of the Fresnel lens. The white reflector and Fresnel lens could also have an elliptical shape.

Figure 3A:
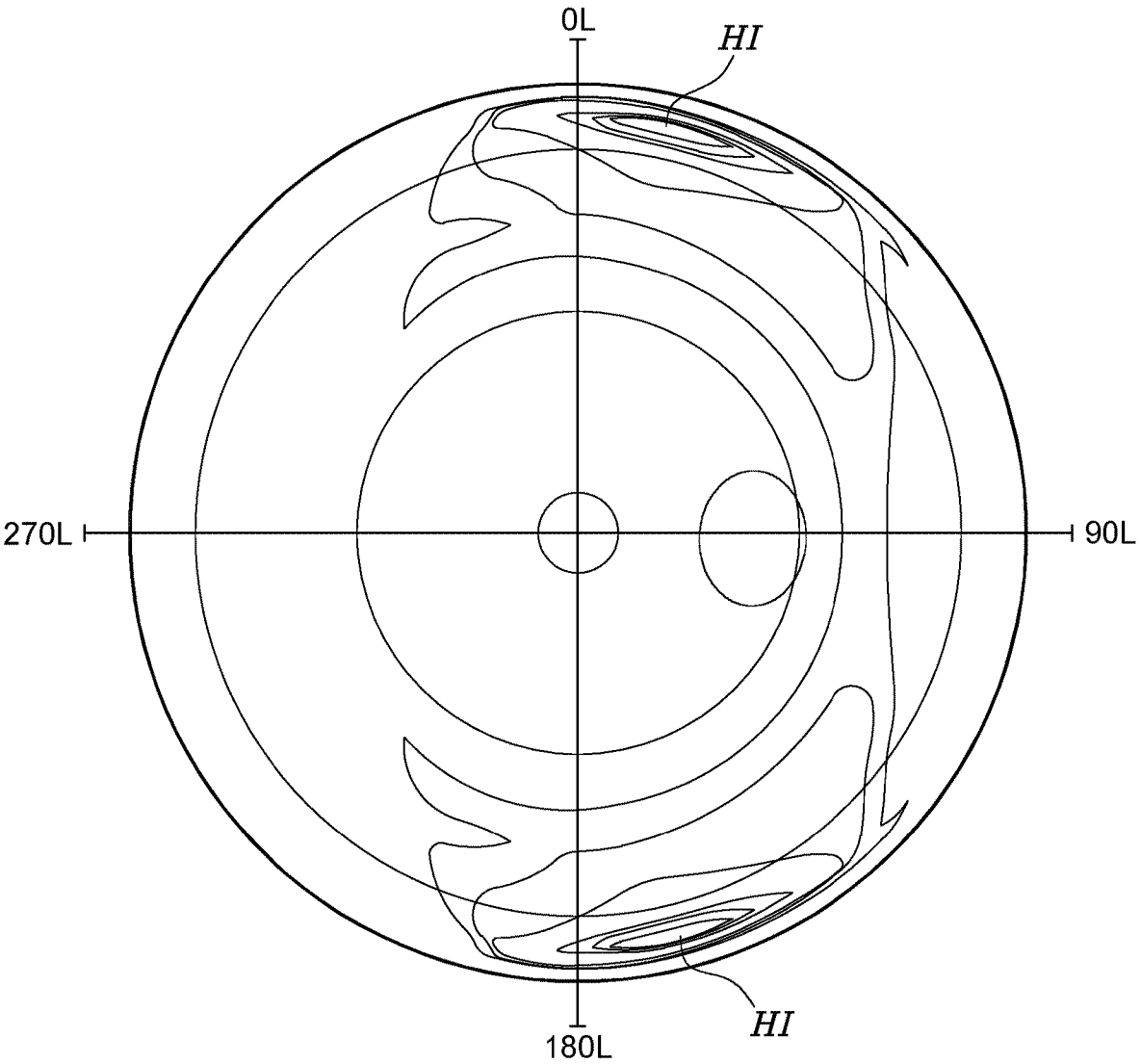
FIG. 3*a* shows the intensity (in cd) as function of theta and phi in the xy-plane with an optimized reflector (3*a*).
Figure 3B:
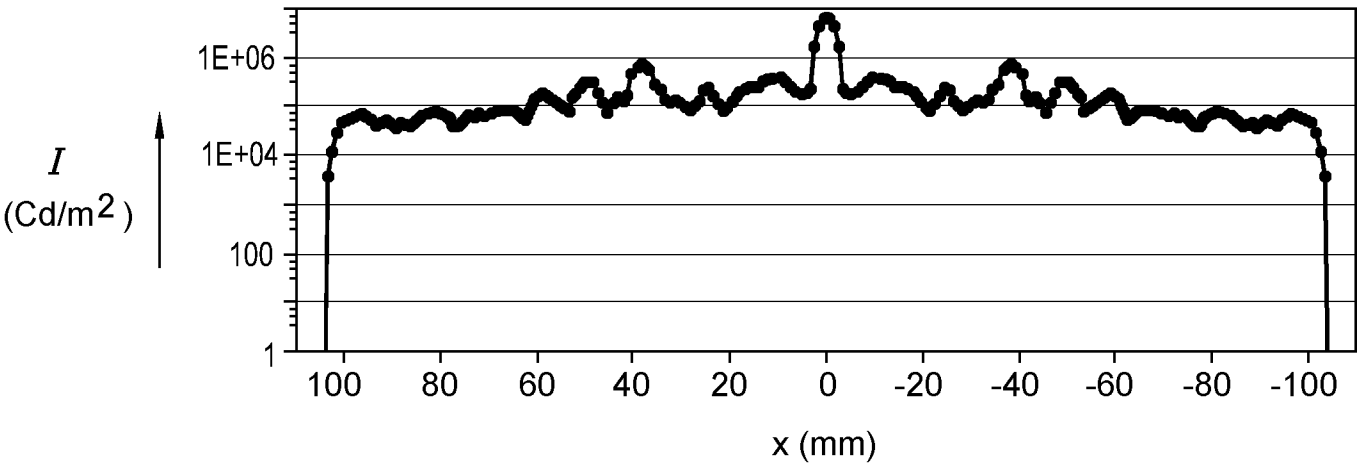
FIG. 3*b* shows the luminance (cd.m$^2$) of the exit window, with on the x-axis the distance from the center of the window and on the y-axis the intensity (luminance) in cd/m$^2$, with viewing direction perpendicular to the module with the lens.

FIG. 3*a* provides the intensity profile (in candela) of an optimized system. Reference HI indicates a high intensity region; FIG. 3*a* schematically depicts a relative even (but non-symmetric) distribution of the intensity with the beam of light generated by the lighting system. FIG. 3*b* shows the luminance of the luminaire (the CoB generates 10 klm in this example). The image illustrates that the luminance is on every location in the optical cavity >20 kcd/$m^2$. The viewing direction is perpendicular to the module (i.e. parallel to the optical axis).

Figure 4B:
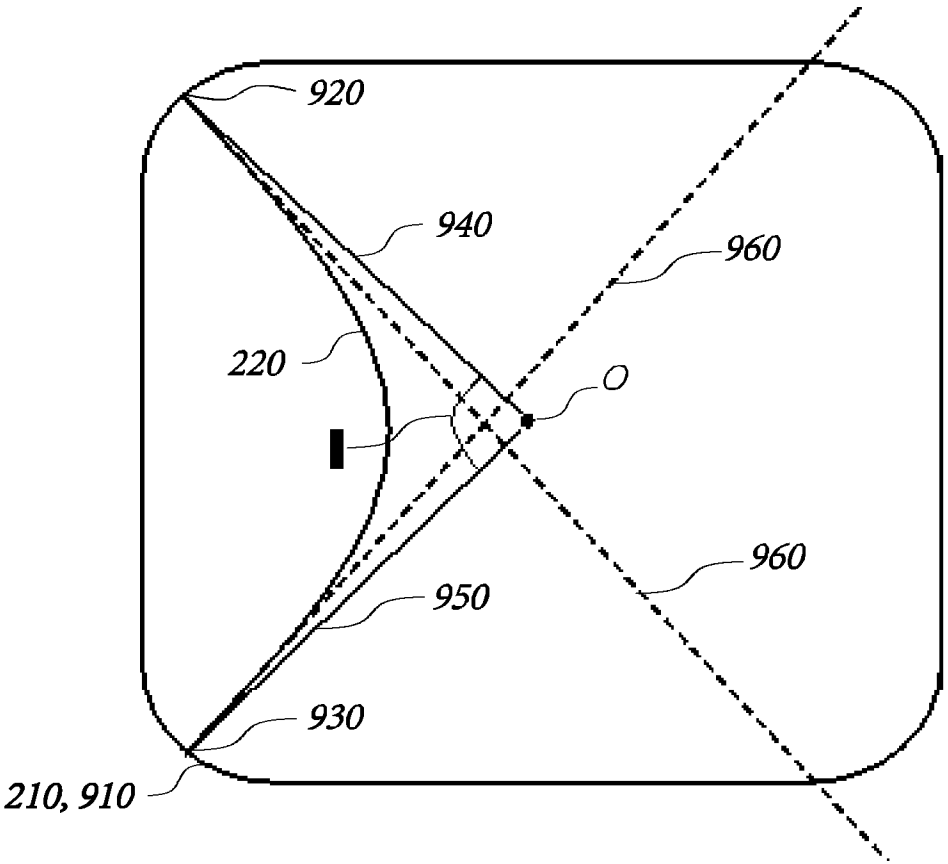
FIGS. 4*a*-4*b* schematically show two embodiments of the segmentation of the first reflective element by the second reflective element.
Figure 4A:
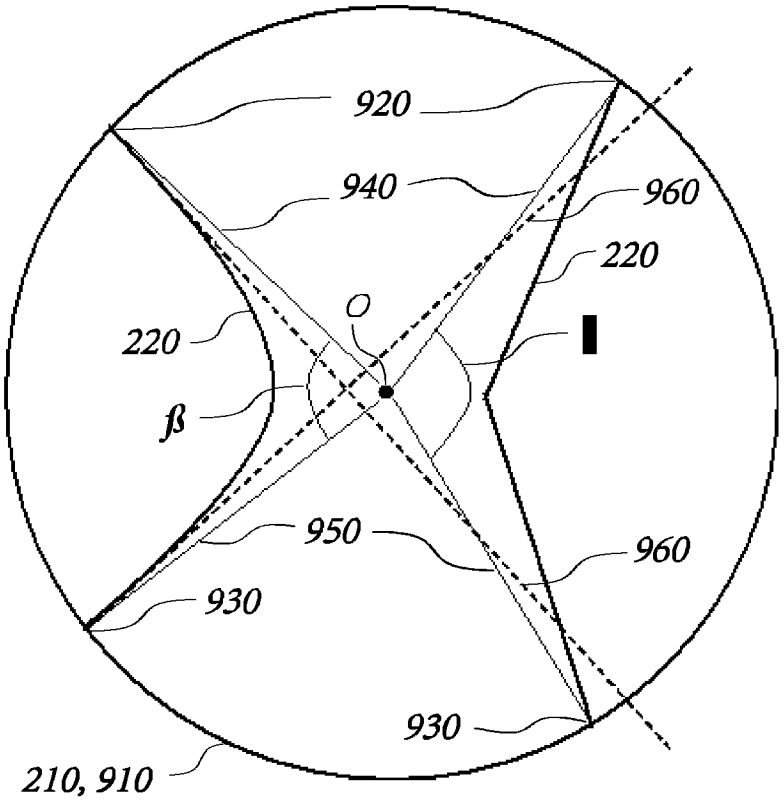

FIGS. 4*a*-4*b* schematically show two embodiments of the lighting system with segmentation of the first reflective element 210 by the second reflective element 220. In FIG. 4*a* the second reflective element 220 consists of a first and a second separate part which are mutually convex towards each other when viewed and projected along the optical axis O on the XY-plane. In FIG. 4*b* the second reflective element 220 is in one part only.

As shown in both FIG. 4*a* and FIG. 4*b*, the second reflective element 220 has the feature that not any tangent 960 to a reflective surface (which faces towards the light source located at the optical axis O) of the second reflective element 220 extends through the optical axis O. Furthermore, it is shown that the second reflective element 220 divides the first reflective surface 213 in two respectively three segments and that both end portions of each separate part of the second reflective element 220 divides a perimeter 910 of the first reflective element 210, a circle in FIG. 4*a* and a rectangle in FIG. 4*b*, into perimeter portions. The second reflective element especially connects one point 920 on the perimeter 910 with another point 930 on the same perimeter 910, said one point 920 and said another point 930 are lying apart on the perimeter 910, with lines 940, 950 from the optical axis O respectively to said one point 920 and to said another point 930 mutually at an angle β, with β in an angle range 60°<=β<=170°.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting system comprising a light source, configured to provide light source light, a first reflective element, a lens at a varying distance (d2) from the first reflective element, and a second reflective element in between the first reflective element and the lens, wherein:

the first reflective element tapers from a first end to a second end, wherein the first reflective element comprises a first reflective surface bridging the distance between the first end and the second end, wherein the first reflective surface is diffuse reflective, and wherein the light source is at least partially circumferentially surrounded by the first reflective surface;

the light source is configured closer to the second end than to the first end, and wherein the light source is configured to direct at least part of the light source light in the direction of the first end;

the lens is configured to beam shape at least part of the light source light emanating from the reflective element and the light source; and the second reflective element is configured to redirect part of the light source light to the lens, wherein the second reflective element is configured to specularly reflect at least part of the light source light that reaches the second reflective element, and wherein the second reflective element has different heights (h2) over its length so that over its full length at each location the second reflective element bridges the distance (d2) between the first reflective element and the lens.

2. The lighting system according to claim 1, wherein the lens comprises a Fresnel lens, and wherein the light source comprises a chip-on-board light source.

3. The lighting system according to claim 1, wherein the first reflective element has an opening angle ($\alpha$), defined by the reflective surface, of at least 120° and of at maximum 170°.

4. The lighting system according to claim 1, wherein the first reflective element is rotationally symmetric.

5. The lighting system according to claim 1, wherein the first reflective element is non-rotationally symmetric, and wherein at least part of the first reflective element is a 3D printed part.

6. The lighting system according to claim 1, wherein the second reflective element is configured to specularly reflect at least 50% of the light source light that reaches the second reflective element.

7. The lighting system according to claim 6, wherein the first reflective element comprises a reflector wall comprising the first reflective surface, wherein the reflector wall comprises a slot for hosting a second reflective element.

8. The lighting system according to claim 7, wherein the first reflective element is rotationally symmetric, and wherein the slot defines part of a circle segment, wherein the circle segment has a secant, which may optionally be curved, and wherein the slot defines at least part of the secant.

9. The lighting system according to claim 1, wherein the first reflective element is a truncated cone or pyramid having a base with a perimeter, and wherein the second reflective element connects one point on the perimeter with another point on the same perimeter, said one point and said another point are lying apart on the perimeter by an angle $\beta$, with $\beta$ in an angle range $60° <= \beta <= 170°$.

10. The lighting system according to claim 1, wherein not any tangent to a reflective surface, which faces towards the light source, of the second reflective element extends through an optical axis (O).

11. A lamp comprising the lighting system according to claim 1, wherein the lamp is configured to provide a beam of lamp light with a non-rotationally symmetric shape.

12. A kit of parts comprising (i) the lighting system according to claim 1, wherein the first reflective element comprises a reflector wall comprising the first reflective surface, wherein the reflector wall comprises a slot for hosting a second reflective element, and wherein the kit of parts further comprises (ii) the second reflective element, wherein the second reflective element when configured in the slot is configured to specularly reflect at least 50% of the light source light that reaches the second reflective element during operation of the lighting system.

13. The kit of parts according to claim 10, wherein the reflector wall comprises a plurality of slots, and wherein the kit of parts comprises a plurality of different second reflective elements, wherein the second reflective elements are flexible.

14. A method of providing the lighting system according to claim 1, wherein the method comprises (i) providing the light source, the first reflective element and the lens, and (ii) assembling these into the lighting system, wherein the method comprises providing a reflector wall comprising the first reflective surface, wherein the reflector wall comprises a slot, wherein the method further comprises providing a second reflective element and configuring the second reflective element in the slot, wherein the second reflective element when configured in the slot is configured to specularly reflect at least 50% of the light source light that reaches the second reflective element during operation of the lighting system.

15. A method of providing light, the method comprising providing lighting system light with the lighting system according to claim 1, wherein relative to an optical axis (O) of the lighting system at least 60% of the lighting system light is provided within an angular range of 40-90° relative to the optical axis (O).

* * * * *